US010189266B2

(12) United States Patent
Koide

(10) Patent No.: US 10,189,266 B2
(45) Date of Patent: Jan. 29, 2019

(54) LIQUID EJECTION APPARATUS

(71) Applicant: BROTHER KOGYO KABUSHIKI KAISHA, Nagoya-shi, Aichi-ken (JP)

(72) Inventor: Shohei Koide, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/464,491

(22) Filed: Mar. 21, 2017

(65) Prior Publication Data

US 2017/0282587 A1 Oct. 5, 2017

(30) Foreign Application Priority Data

Mar. 29, 2016 (JP) ..... 2016-066103

(51) Int. Cl.
*B41J 2/175* (2006.01)
*B41J 2/165* (2006.01)

(52) U.S. Cl.
CPC ..... *B41J 2/17596* (2013.01); *B41J 2/16505* (2013.01)

(58) Field of Classification Search
CPC .... B41J 2/17509; B41J 2/17596; B41J 2/175; B41J 2/17513; B41J 2/17556; B41J 2/17566; B41J 2/17503; B41J 29/38; B41J 2/16505
USPC ..... 347/6, 7, 14, 29, 30, 84–86
See application file for complete search history.

(56) References Cited

U.S. PATENT DOCUMENTS

2013/0106963 A1* 5/2013 Kawase ..... B41J 2/17509 347/85
2015/0224786 A1* 8/2015 Otsuka ..... B41J 2/17596 347/92
2016/0075144 A1* 3/2016 Sugitani ..... B41J 2/17596 347/6

FOREIGN PATENT DOCUMENTS

JP 2004-209665 A 7/2004
JP 2009-178889 A 8/2009
JP 2011-230317 A 11/2011
JP 2015-077696 A 4/2015

* cited by examiner

*Primary Examiner* — Jannelle M Lebron
(74) *Attorney, Agent, or Firm* — Scully, Scott, Murphy & Presser, P.C.

(57) ABSTRACT

A liquid ejection apparatus is disclosed. One apparatus includes a nozzle through which fluid is ejected or purged, and a pressure regulating valve arranged upstream of the nozzle. The pressure regulating valve is configured to open in response to an open/close pressure differential of the fluid across the pressure regulating valve. The pressure regulating valve is configured to controllably regulate the open/close pressure differential. The apparatus further includes a controller configured to, when a suction pump is being operated to perform a first purging operation comprising creating a first negative pressure through suctioning by the suction pump to purge the fluid through the nozzle, control the pressure regulating valve to set the open/close pressure differential of the pressure regulating valve to a first value.

14 Claims, 15 Drawing Sheets

(DURING INK EJECTION)

(STRONG PURGING)

(WEAK PURGING)

(STRONG-WEAK SIMULTANEOUS PURGING)

LIQUID EJECTION APPARATUS

CROSS-REFERENCE TO RELATED APPLICATION

This application claims priority from Japanese Patent Application No. 2016-066103 filed on Mar. 29, 2016, the content of which is incorporated herein by reference in its entirety.

FIELD OF DISCLOSURE

The disclosure relates to a liquid ejection apparatus.

BACKGROUND

A known liquid ejection apparatus includes a line printer including a plurality of head units. Each of the head units is connected to a common fluid supply (e.g., a sub-tank). A pressure regulating valve is disposed between the fluid supply and the head units to maintain constant pressure in the respective head units. The pressure regulating valve is configured to open when a pressure differential across the valve becomes greater than a predetermined value. When a head unit ejects fluid, e.g., ink, an ink pressure in a chamber disposed downstream of the valve may be reduced, which may cause the pressure regulating valve to open. Accordingly, ink is supplied from the fluid supply.

Another known liquid ejection apparatus includes a negative pressure regulating unit between a fluid ejection head and a tank. The negative pressure regulating unit is configured to open and close in accordance with a pressure differential across the unit. The negative pressure regulating unit is configured to regulate or adjust an opening/closing pressure differential for opening/closing the unit. More specifically, the opening/closing pressure differential is altered by changing a load applied to a valve member with a weight placed on a movable plate that contacts a spring.

SUMMARY

Those liquid ejection apparatuses may have nozzle ejection failures, due to viscous fluid in nozzles (e.g., fluid viscosity increased due to drying), or foreign matters, contaminants or air bubbles entered into a passage including the nozzles. Known liquid ejection apparatuses generally perform a recovery operation called "purging" to clear viscous fluid, foreign matters, contaminants and/or air bubbles by suctioning such obstruction from the liquid ejection apparatuses through their nozzles.

In the liquid ejection apparatus including the pressure regulating valve provided between the head units and the fluid supply, if an open/close pressure differential (e.g., a pressure differential when the valve opens and closes) is great, the valve opens with a relatively great negative pressure applied to the nozzles, so that the fluid may flow within a head unit at high speed. Accordingly, foreign matters, which may be a cause of ejection failures, may be discharged or removed effectively. If the open/close pressure differential for the pressure regulating valve is fixed to a small differential, the valve opens before a relatively great negative pressure is created within the head unit during the suctioning through the nozzles with relatively strong force, resulting in ineffective purging.

One or more aspects of the disclosure provide a liquid ejection apparatus that may execute purging effectively by setting an open/close pressure differential for a pressure regulating valve appropriately.

According to an aspect of the disclosure, a liquid ejection apparatus includes a nozzle through which fluid is ejected or purged, and a pressure regulating valve arranged upstream of the nozzle. The pressure regulating valve is configured to open in response to an open/close pressure differential of the fluid across the pressure regulating valve. The pressure regulating valve is configured to controllably regulate the open/close pressure differential. The liquid ejection apparatus further includes a controller configured to, when a suction pump is being operated to perform a first purging operation comprising creating a first negative pressure through suctioning by the suction pump to purge the fluid through the nozzle, control the pressure regulating valve to set the open/close pressure differential of the pressure regulating valve to a first value.

According to further aspect of the disclosure, a liquid ejection apparatus for controlling a nozzle through which fluid is ejected or purged and a pressure regulating valve arranged upstream of the nozzle. The pressure regulating valve is configured to open in response to an open/close pressure differential of the fluid across the pressure regulating valve. The pressure regulating valve is configured to controllably regulate the open/close pressure differential. The liquid ejection apparatus includes a controller. The controller is configured to, when a suction pump is being operated to perform a first purging operation comprising creating a first negative pressure through suctioning by the suction pump to purge the fluid through the nozzle, control the pressure regulating valve to set the open/close pressure differential of the pressure regulating valve to a first value.

DETAILED DESCRIPTION

Figure 1:
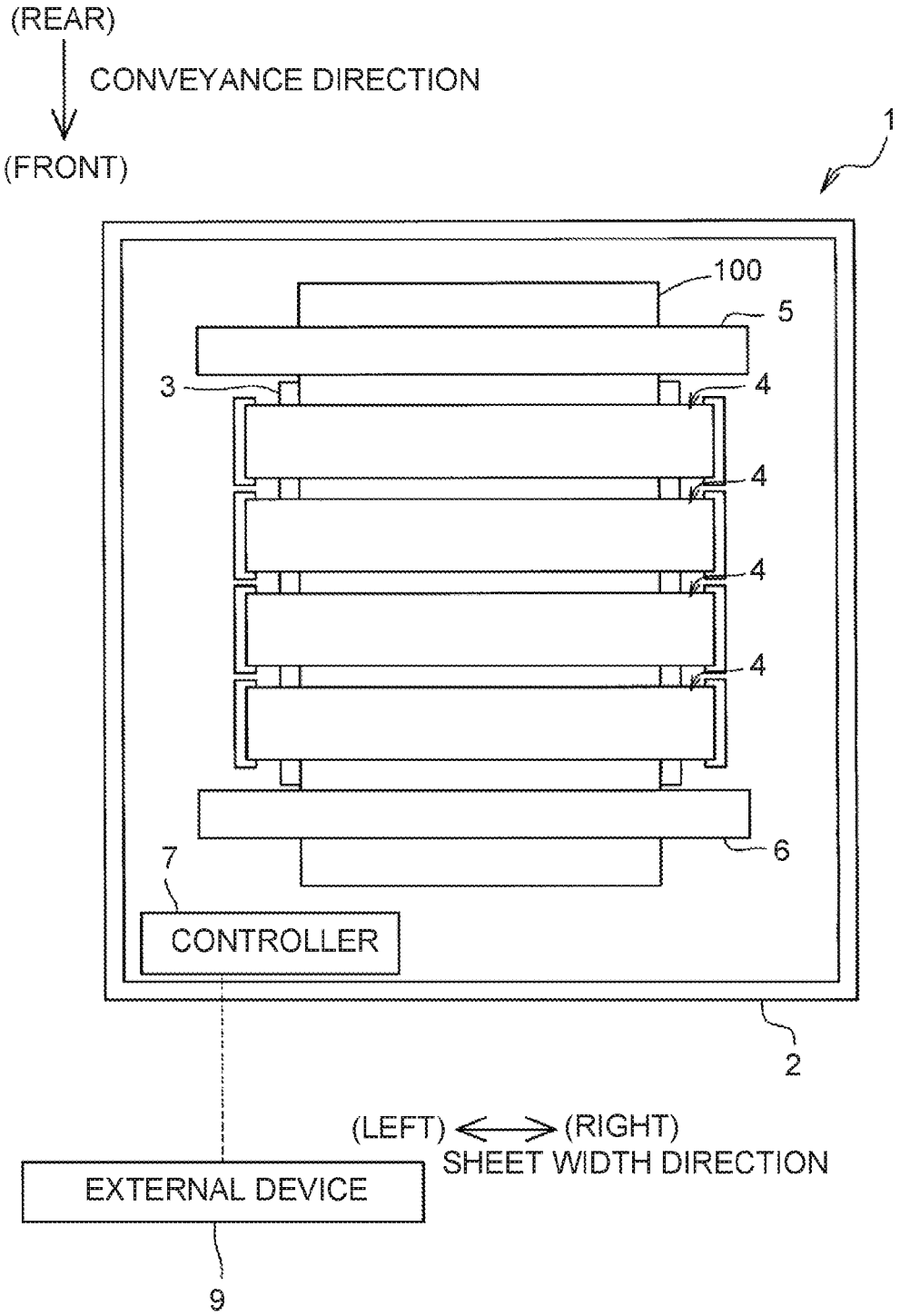
FIG. 1 is a plan view of a printer illustrating a configuration thereof in an illustrative embodiment according to one or more aspects of the disclosure.
Figure 2:
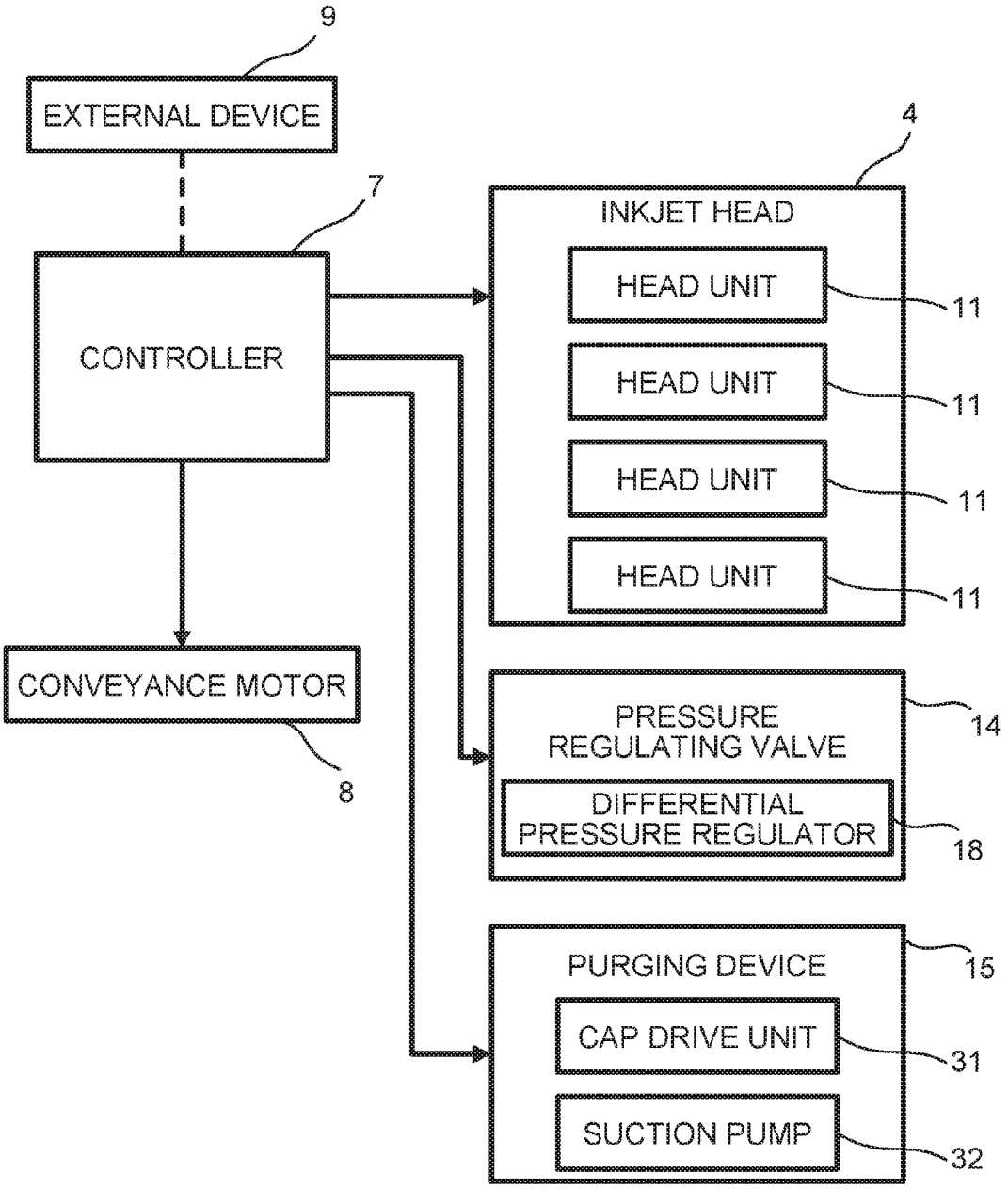
FIG. 2 is a block diagram illustrating an electrical configuration of the printer according to one or more aspects of the disclosure.

An illustrative embodiment and its modification according to one or more aspects of the disclosure are described in detail with reference to the accompanying drawings. FIG. 1 is a plan view of a printer 1 illustrating a configuration thereof in an illustrative embodiment. FIG. 2 is a block diagram illustrating an electrical configuration of the printer 1. The front, rear, left, right sides of the printer 1 are defined as labelled in FIG. 1. A front side of the drawing sheet of FIG. 1 is defined as a top/upper side of the printer 1. An opposite, rear side of the drawing sheet of FIG. 1 is defined as a bottom/lower side of the printer 1. The disclosure will be described in conjunction with directional terminology, such as "top," "bottom," "front," "back," "left," "right," etc.

<General Structure of Printer>

As depicted in FIG. 1, the printer 1 includes a platen 3 and liquid ejection apparatus, e.g., four inkjet heads 4, conveyance rollers 5 and 6, and a controller 7, which are housed in a casing 2.

Figure 3:
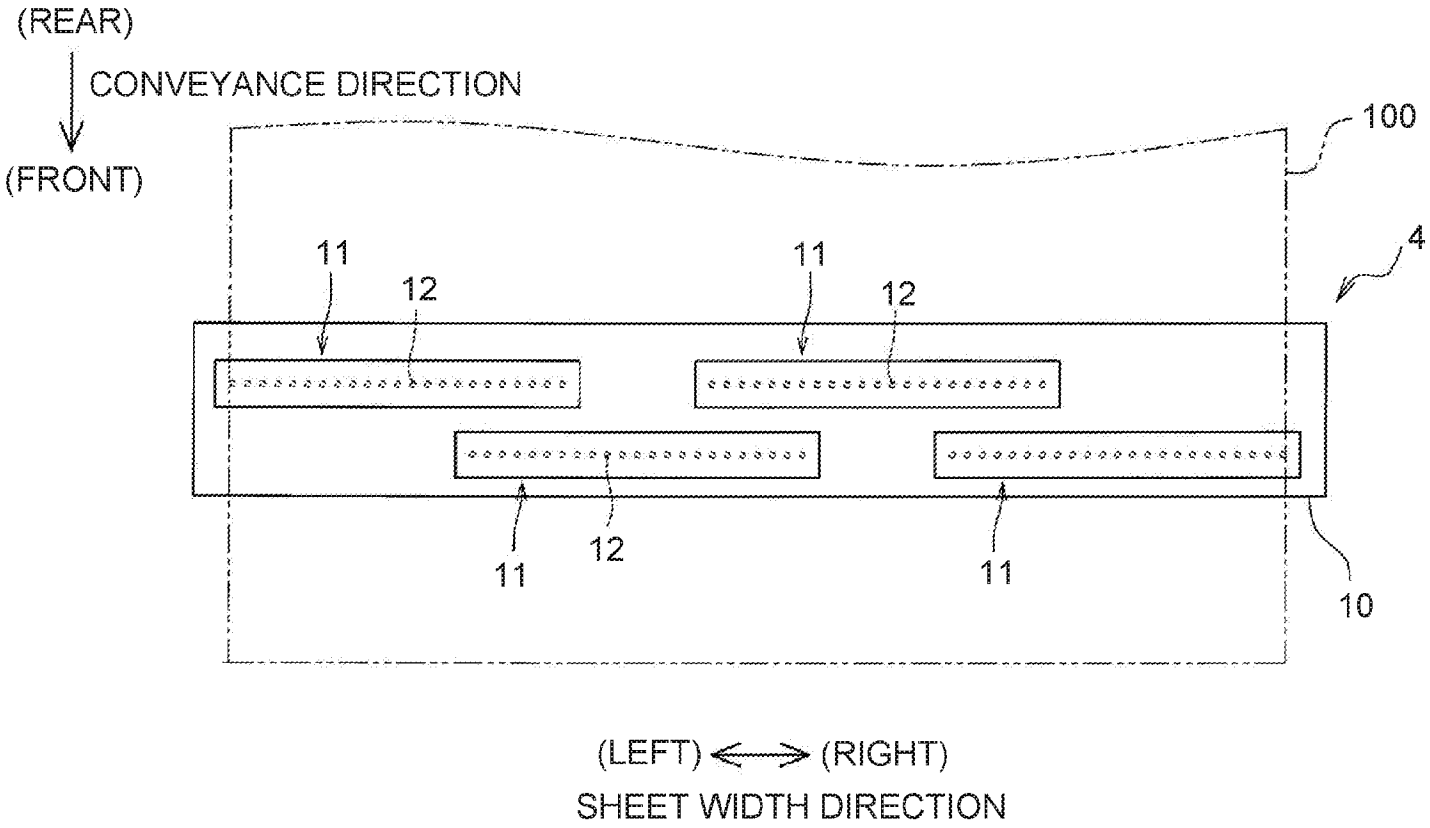
FIG. 3 is a plan view of an inkjet head of the printer according to one or more aspects of the disclosure.

An upper surface of the platen 3 supports a recording sheet 100, which is being conveyed, from below. The four inkjet heads 4 are arranged above the platen 3 in line along the front-rear direction. Each of the inkjet heads 4 is a line print head. Each inkjet head 4 includes a plurality of nozzles 12. The head 4 is elongated in a width direction of the recording sheet 100 (e.g., the left-right direction). As depicted in FIG. 3, the nozzles 12 are aligned in the left-right direction. Each inkjet head 4 is configured to receive ink from a corresponding ink tank via a corresponding sub-tank 13 (refer to FIG. 4). Each of the inkjet heads 4 is configured to receive a corresponding one of different colors of ink. In short, the printer 1 is, but not limited to, a color printer.

As depicted in FIG. 1, the conveyance rollers 5 and 6 are disposed, respectively in front of and behind the platen 3. The conveyance rollers 5 and 6 are configured to be driven by a conveyance motor 8 (refer to FIG. 2). The rollers 5 and 6 are configured to convey the recording sheet 100 over the platen 3 forwardly (e.g., in a conveyance direction).

The controller 7 includes a central processing unit (CPU), a read only memory (ROM), a random access memory (RAM), and an application specific integrated circuit (ASIC) including control circuits. As depicted in FIG. 2, the controller 7 is configured to control components or units of the printer 1, such as the inkjet heads 4, the conveyance motor 8, a purging device 15, and a pressure regulating valve 14 (to be described below).

The controller 7 is configured to perform data communication with an external device 9, e.g., a personal computer. Upon receiving image data from the external device 9, the controller 7 controls the inkjet heads 4 and the conveyance motor 8 to print an image on the recording sheet 100. The controller 7 causes the conveyance rollers 5 and 6 to convey the recording sheet 100 and the four inkjet heads 4 to eject ink onto the recording sheet 100. A desired image may thus be printed on the recording sheet 100.

<Details of Inkjet Head and its Peripherals>

Figure 4:
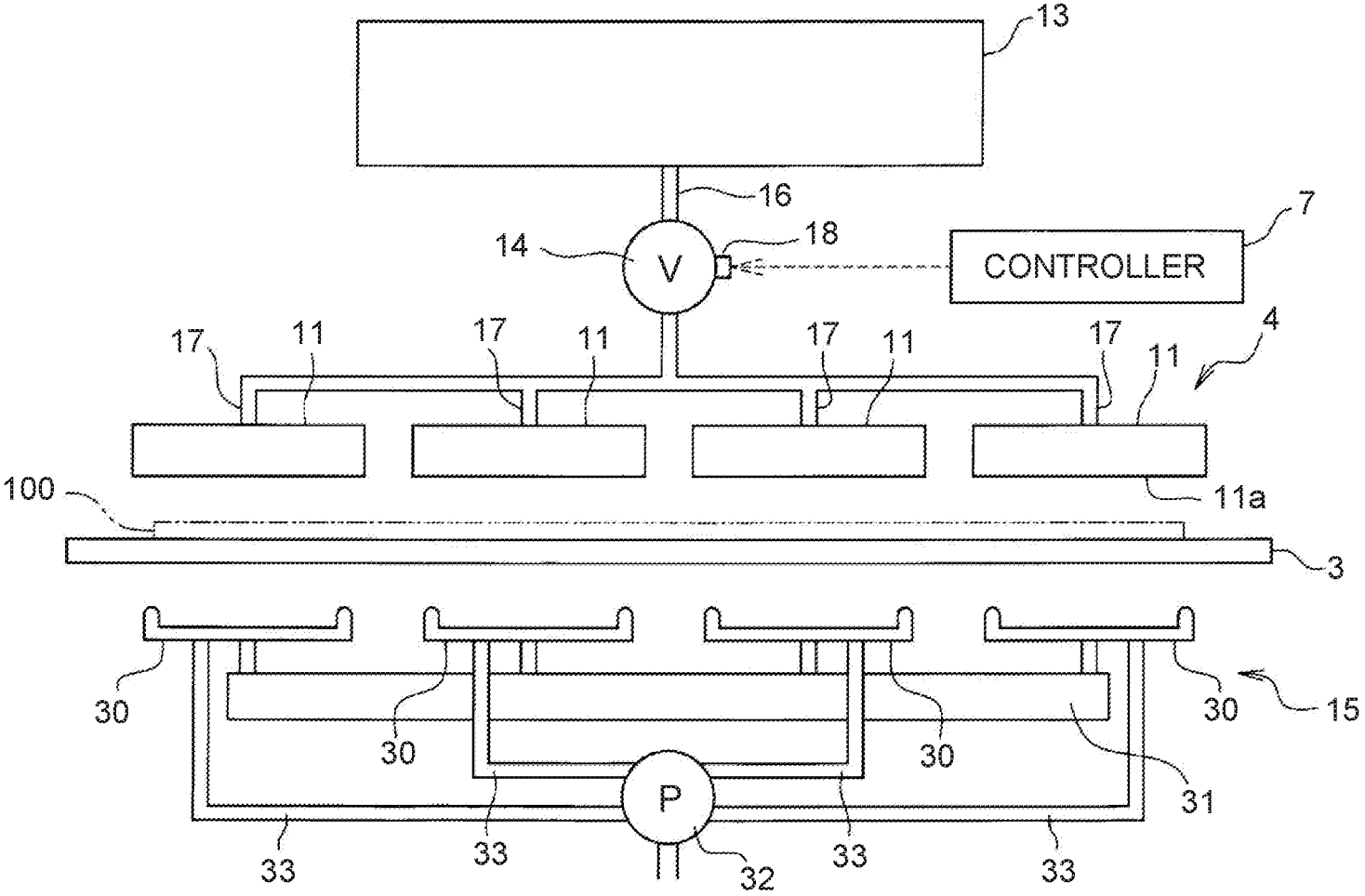
FIG. 4 is a schematic diagram of the inkjet head, a sub-tank, a pressure regulating valve, and a purging device according to one or more aspects of the disclosure.

Next, the inkjet head 4 and its peripherals, e.g., the sub-tank 13, the pressure regulating valve 14, and the purging device 15, are described in detail with reference to FIGS. 3 and 4. FIG. 3 is a plan view of the inkjet head 4. FIG. 4 is a schematic diagram of the inkjet head 4, the sub-tank 13, the pressure regulating valve 14, and the purging device 15, illustrating their connections.

(Inkjet Head)

The structure of the inkjet head 4 will be described. As depicted in FIG. 3, the inkjet head 4 includes a holder 10 having a rectangular configuration elongated in the left-right direction and four head units 11 attached to the holder 10.

The four head units 11 are arranged in two rows in a staggered manner along the left-right direction.

Each of the head units 11 has a nozzle surface 11*a* (refer to FIG. 4) at a lower surface thereof. The nozzle surface 11*a* includes a plurality of nozzles 12. The nozzles 12 are arranged equidistantly in a line in the left-right direction, forming a nozzle row. The four head units 11 constitute a one-line print head. In the example shown in FIG. 3, each of the leftmost and rightmost nozzles 12 is positioned facing a corresponding end of the recording sheet 100 in its width direction.

(Sub-Tank)

As depicted in FIG. 4, the inkjet head 4 is connected to a corresponding fluid supply, e.g., the sub-tank 13. The sub-tank 13 stores ink of a corresponding color. The sub-tank 13 is disposed over the inkjet head 4. The sub-tank 13 is configured to temporarily store ink from an ink tank (not depicted). The sub-tank 13 and the four head units 11 are connected by a common passage 16 and four branch passages 17 branching from the common passage 16. The common passage 16 and the four branch passages 17 may include, for example, tubing. In another example, the sub-tank 13 and the inkjet head 4 may constitute a laminated structure with a channeled member disposed therebetween and the passages 16 and 17 may be formed in the channeled member.

(Pressure Regulating Valve)

The pressure regulating valve 14 is disposed in the common passage 16. The pressure regulating valve 14 is, for example, a differential pressure regulating valve. The valve 14 may be configured to open if a pressure differential across the pressure regulating valve 14 overcomes or exceeds a predetermined open/close pressure differential. Accordingly, negative pressures in the respective head units 11, which may have different operating burdens during image formation, may be maintained approximately constant, stabilizing ink ejection from the nozzles 12. The open/close pressure differential may be set to such a value that may prevent meniscus from being damaged when ink ejection causes negative pressures in the head units 11.

Figure 6:
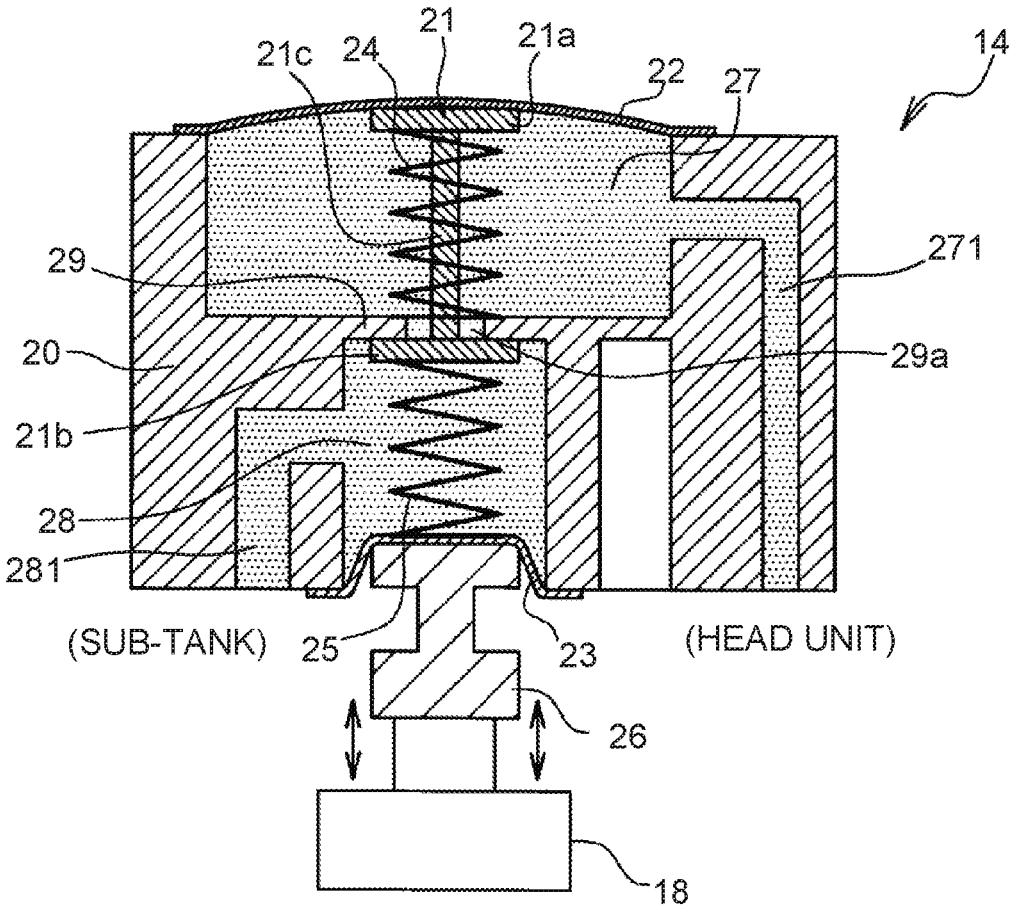
FIG. 6 is a cross-sectional view of the pressure regulating valve illustrating an adjustment of a pressure differential according to one or more aspects of the disclosure.

As depicted in FIG. 6, the pressure regulating valve 14 includes a differential pressure regulator 18 configured to regulate or adjust the open/close pressure differential based on a signal from the controller 7. Regulation or adjustment of the open/close pressure differential will be described in detail later.

Figure 5A:
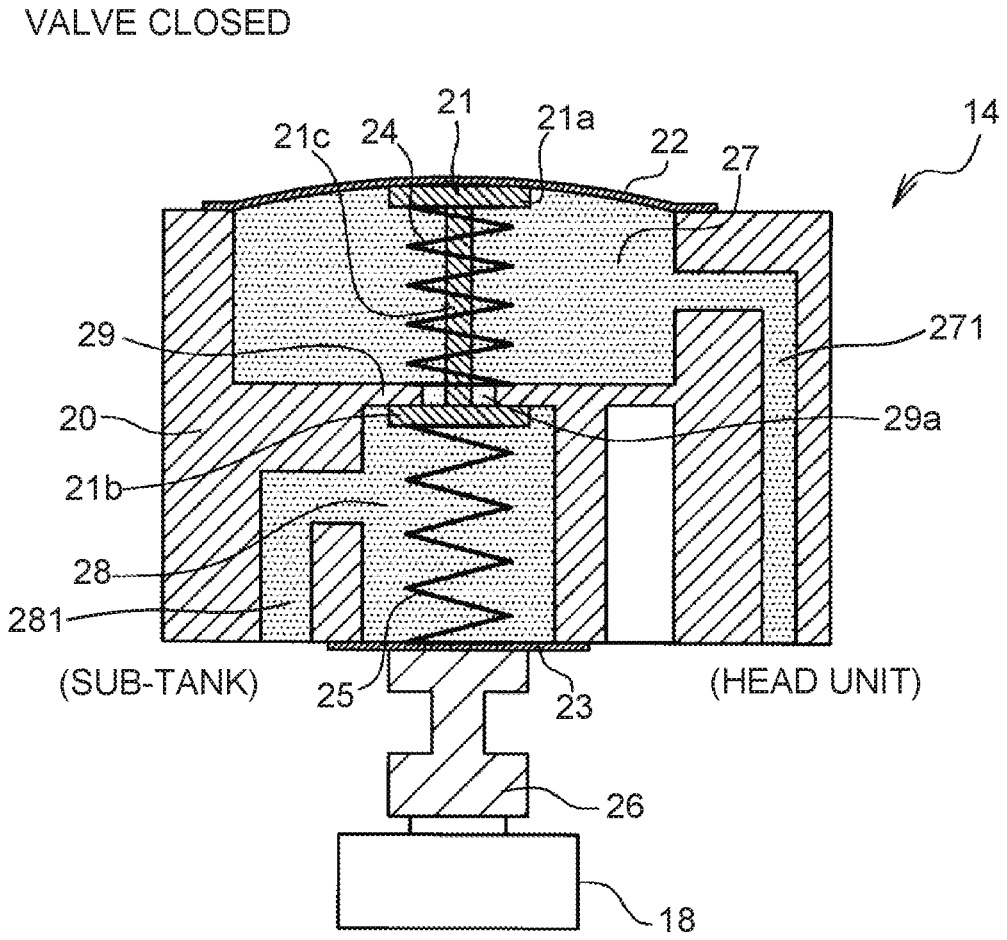
FIG. 5A is a cross-sectional view of the pressure regulating valve in a closed state according to one or more aspects of the disclosure.
Figure 5B:
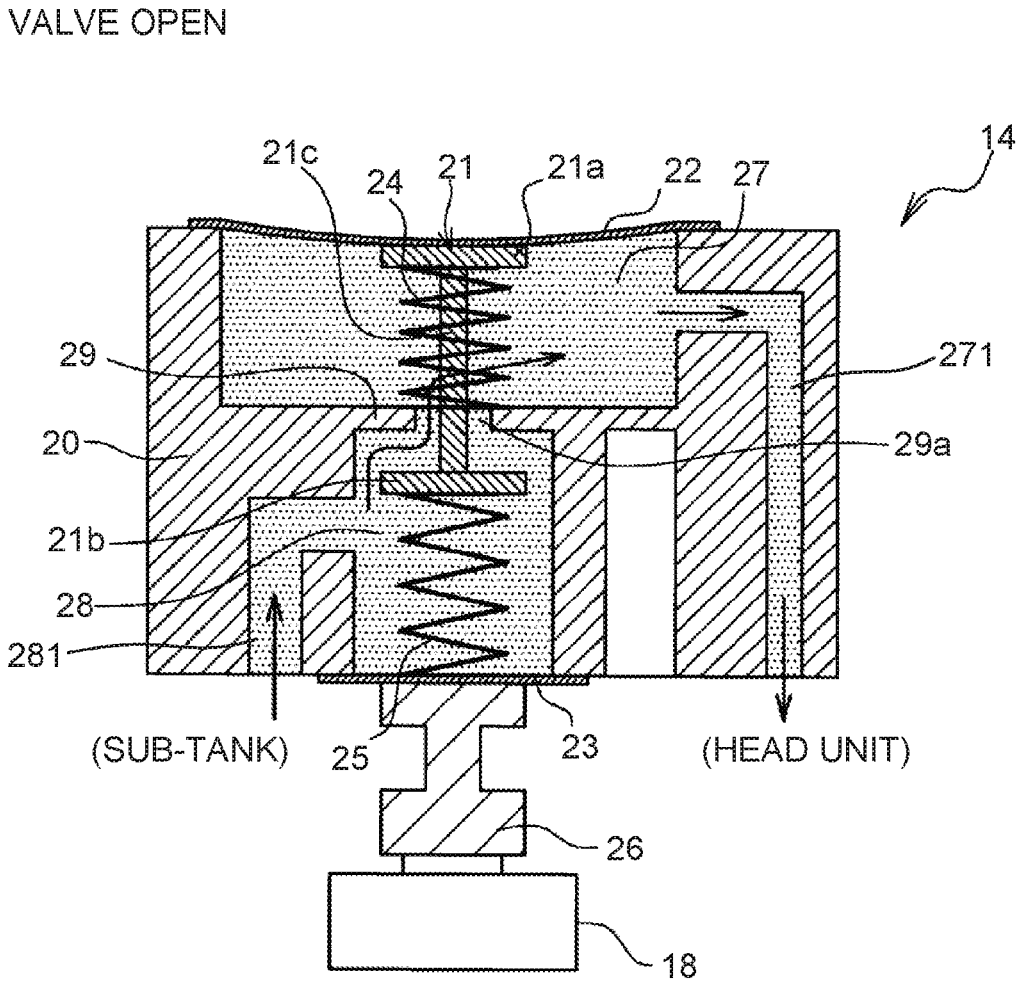
FIG. 5B is a cross-sectional view of the pressure regulating valve in an open state according to one or more aspects of the disclosure.

Next, the structure of the pressure regulating valve 14 will be described with reference to FIGS. 5A-6. FIG. 5A is a cross-sectional view of the pressure regulating valve 14 in a closed state. FIG. 5B is a cross-sectional view of the pressure regulating valve 14 in an open state. FIG. 6 a cross-sectional view of the pressure regulating valve 14, illustrating an adjustment of a pressure differential. As depicted in FIGS. 5A and 5B, the pressure regulating valve 14 includes a valve body 20, a valve member 21, a flexible member, e.g., a first film 22, a second film 23, a first spring 24, a second spring 25, a pressing member 26, and the differential pressure regulator 18.

The valve body 20 includes a head unit side passage and a sub-tank side passage. The head unit side passage includes a first fluid chamber 27 and a first connecting passage 271. The sub-tank side passage includes a second fluid chamber 28 and a second connecting passage 281. The fluid chambers 27 and 28 are disposed adjacent to each other with a partition wall 29 therebetween. The partition wall 29 has a connecting portion 29*a* therethrough. An example of a passage is the connecting portion 29*a*. The fluid chambers 27 and 28 are allowed to fluidly communicate with each other via the connecting portion 29*a*. The first fluid chamber 27 opens toward one side (e.g., the chamber 27 having an open upper end in FIG. 6), whereas the second fluid chamber 28 opens toward the other side (e.g., the chamber 28 having an open lower end in FIG. 6). The opening of the first fluid chamber 27 is sealed by the thin first film 22 while the opening of the second fluid chamber 28 is sealed by the thin second film 23. The first connecting passage 271 fluidly connects the first fluid chamber 27 to the head units 11. The second connecting passage 281 connects the second fluid chamber 28 to the sub-tank 13.

The valve member 21 includes a movable plate 21*a*, a disc 21*b*, and a stem 21*c* connecting the movable plate 21*a* to the disc 21*b*. The movable plate 21*a* is disposed in the first fluid chamber 27 and contacts a lower surface of the first film 22 (e.g., a surface closer to the first fluid chamber 27). The disc 21*b* is disposed in the second fluid chamber 28. The disc 21*b* is configured to move to and away from the lower surface of the partition wall 29 (e.g., a surface of the wall 29 closer to the second fluid chamber 28). Accordingly, the disc 21*b* may contact and be separated from the lower surface of the wall 29. The lower surface of the partition wall 29*a* serves as a seat for the disc 21*b*. The stem 21*c* is inserted into the connecting portion 29*a* and is configured to move up and down, e.g., in the vertical direction. This configuration allows the valve member 21 to move between a closed position (refer to FIG. 5A) and an open position (refer to FIG. 5B). At the closed position, the disc 21*b* contacts the seat, and two fluid chambers 27 and 28 are separated from each other, e.g., do not fluidly communicate with each other. At the open position, the disc 21*b* is separated or moved away from the seat, and the two fluid chambers 27 and 28 fluidly communicate with each other via the connecting portion 29*a*.

The first spring 24 is disposed in the first fluid chamber 27 at a position between the movable plate 21*a* and the partition wall 29 in a compressed manner. The first spring 24 biases the movable plate 21*a* upward. The second spring 25 is disposed in the second fluid chamber 28 at a position between the disc 21*b* and the second film 23 in a compressed manner. The second spring 25 biases the disc 21*b* upward. Each spring 24 and 25 biases the valve member 21 toward the closed position as depicted in FIG. 5A. Each of the springs 24 and 25 may be, for example, a coil spring. The stem 21*c* is disposed inside a loop or coils of the first spring 24.

The pressing member 26 is disposed outside the second fluid chamber 28 and contacts the second film 23. The pressing member 26 supports the second spring 25 from below via the second film 23. The biasing force of the second spring 25 against the disc 21*b* may be changed according to a positional relationship between the valve body 20 and the pressing member 26.

The first film 22 is deformable within a predetermined range in association with a pressure within the first fluid chamber 27. With the aid of the valve member 21 and the springs 24 and 25, the first film 22 may convert the pressure generated or created within the first fluid chamber 27 (e.g., the head unit 11) into a force to move the valve member 21. A pressure created within first fluid chamber 27 may cause the first film 22 to deform in accordance with the pressure. The valve member 21 and the springs 24 and 25 may tend to stop the deformation of the first film 22 with the biasing force of the springs 24 and 25. As a pressure is generated in the first fluid chamber 27, force to deform the first film 22 may be yielded. This force may act on the valve member 21 and the springs 24 and 25 due to the law of action and reaction. For example, a negative pressure in the first fluid chamber 27 may cause a force corresponding to the negative pressure to act in a direction to lower the valve member 21. At this time, if this force is lower than the biasing force of the springs 24 and 25, the valve member 21 may be maintained at the closed position and the disc 21*b* may be in contact with the seat (e.g., the partition wall 29), as depicted in FIG. 5A.

As ink is being ejected, a negative pressure within the first fluid chamber 27 may increase and a force to lower the valve member 21 may increase accordingly. When this force becomes greater than the biasing force of the springs 24 and 25, the valve member 21 may be lowered and the disc 21*b* may be separated from the seat, as depicted in FIG. 5B. The connecting portion 29*a* thus opens when the negative pressure reaches the open/close pressure differential.

The differential pressure regulator 18 is configured to move the pressing member 26 up and down (e.g., the vertical direction in FIG. 6) based on a signal from the controller 7, thereby changing the biasing force of the second spring 25 toward a valve closing direction. Changes in the biasing force of the second spring 25 may cause changes in the negative pressure in the first fluid chamber 27 required to move the valve member 21 from the closed position to the open position. The open/close pressure differential when the pressure regulating valve 14 opens may thus be regulated or adjusted. The differential pressure regulator 18 is not limited to a specific example, but actuators, such as piezoelectric actuators, solenoid actuators, motors, cylinders, may be used.

(Purging Device)

The purging device 15 is configured to execute purging for each of the four head units 11 of the inkjet head 4. The "purging" is performed for maintaining or recovering ejection performances of the nozzles 12. To maintain and recover the ejection performances, ink may be forcibly discharged from the respective nozzles 12 by purging. Suctioning through the nozzle surface 11*a* (e.g., with negative pressure applied to the nozzles 12) may cause viscous ink or plugs of ink in the head units 11, as well as foreign matters, contaminants, or air bubbles in ink, to be discharged along with the flow of ink. During purging, the inkjet head 4 will not be driven.

As depicted in FIG. 4, the purging device 15 is disposed below the platen 3. The purging device 15 includes caps 30, a cap drive unit 31, and a suction pump 32. Each of the caps 30 may be provided for a respective one of the head units 11. Each cap 30 may mainly include an elastic member, e.g., rubber. The cap 30 includes a flat base portion and a ring-shaped lip portion extending upward from a peripheral portion of the base portion. The cap 30 has a recessed shape in vertical cross section orthogonal to the nozzle surface 11*a*. The lip portion of the cap 30 contacts the nozzle surface 11*a* to cover the nozzles 12.

The cap drive unit 31 is configured to move the caps 30, each at a different timing, in the vertical direction, with one drive source (e.g., a motor). The drive force from the motor is transmitted to four movable members via a plurality of drive force transmission mechanisms (e.g., cam mechanisms). The drive force may be transmitted at a different timing to each of the movable members. The drive force may cause the respective caps 30 to move between respective retracted positions (e.g., below the platen 3) and respective contact positions. The caps 30 are separated from the corresponding nozzle surfaces 11*a* at the retracted positions, and contact the corresponding nozzle surfaces 11*a* at the contact positions. At the contact positions, an end of each lip portion contacts a corresponding nozzle surface 11*a* and seals around the nozzles 12, forming a sealed space within the respective caps 30.

The suction pump 32 is connected to each of the four caps 30 by a respective connection passage 33. The connection passage 33 may be, for example, tubing.

In purging operation, the cap drive unit 31 causes the caps 30 to move to the respective contact positions. With the caps 30 at the contact positions, the suction pump 32 may be activated. Accordingly, the air may be discharged from the sealed space within each cap 30, creating a negative pressure therein. A certain level of negative pressure may create a pressure differential between the sub-tank 13 side and the head unit 11 side (e.g., between the fluid chambers 27 and 28) greater than the open/close pressure differential. Accordingly, the pressure regulating valve 14 may open to allow ink to flow from the sub-tank 13 to the head unit 11. Viscous ink, foreign matters, contaminants and/or air bubbles in the nozzles 12 may be discharged along with the flow of ink.

If the head unit 11 includes lots of foreign matters and/or air bubbles, or ink in the nozzles 12 has a significantly high viscosity, ink may be preferably suctioned through nozzles 12 with relatively strong force to remove those obstacles. In contrast, if ink in the nozzles 12 is not so viscous, the ink may be preferably suctioned with a negative pressure force reduced as much as possible to reduce or minimize ink consumption (e.g., ink discharge amount).

The controller 7 is configured to selectively perform first purging operation, e.g., strong purging, and second purging operation, e.g., weak purging, according to conditions of the respective head units 11. In some examples, the strong purging has a longer time or a higher speed (e.g., a greater amount of air suctioning per unit time) of suctioning by the suction pump 32 than the weak purging.

To create different levels of negative pressures within the caps 30, the suction pump 32 may not necessarily operated differently between the strong purging and the weak purging, because the open/close pressure differential of the pressure regulating valve 14 may be changed between the strong purging and the weak purging, as will be described in detail below. Accordingly, even when ink is suctioned via the nozzle surface 11*a* by the same suctioning force of the suction pump 32 between the strong purging and the weak purging, a time when the pressure regulating valve 14 opens in the strong purging may be later than the time in the weak purging. A relatively greater negative pressure may be created within the caps 30 during the strong purging for the time the valve 14 opens late. To reliably discharge foreign matters and air bubbles in the head units 11, the strong purging has a different suctioning time or suctioning speed of the suction pump 32 from that of the weak purging in the illustrative embodiment.

(Open/Close Pressure Differential of Pressure Regulating Valve)

As described above, the pressure regulating valve 14 according to the illustrative embodiment is configured to regulate or adjust the open/close pressure differential. The controller 7 controls the differential pressure regulator 18 of the pressure regulating valve 14 to change the open/close pressure differential between ink ejection (printing) and purging.

(1) During Ink Ejection (Printing)

Figure 7:
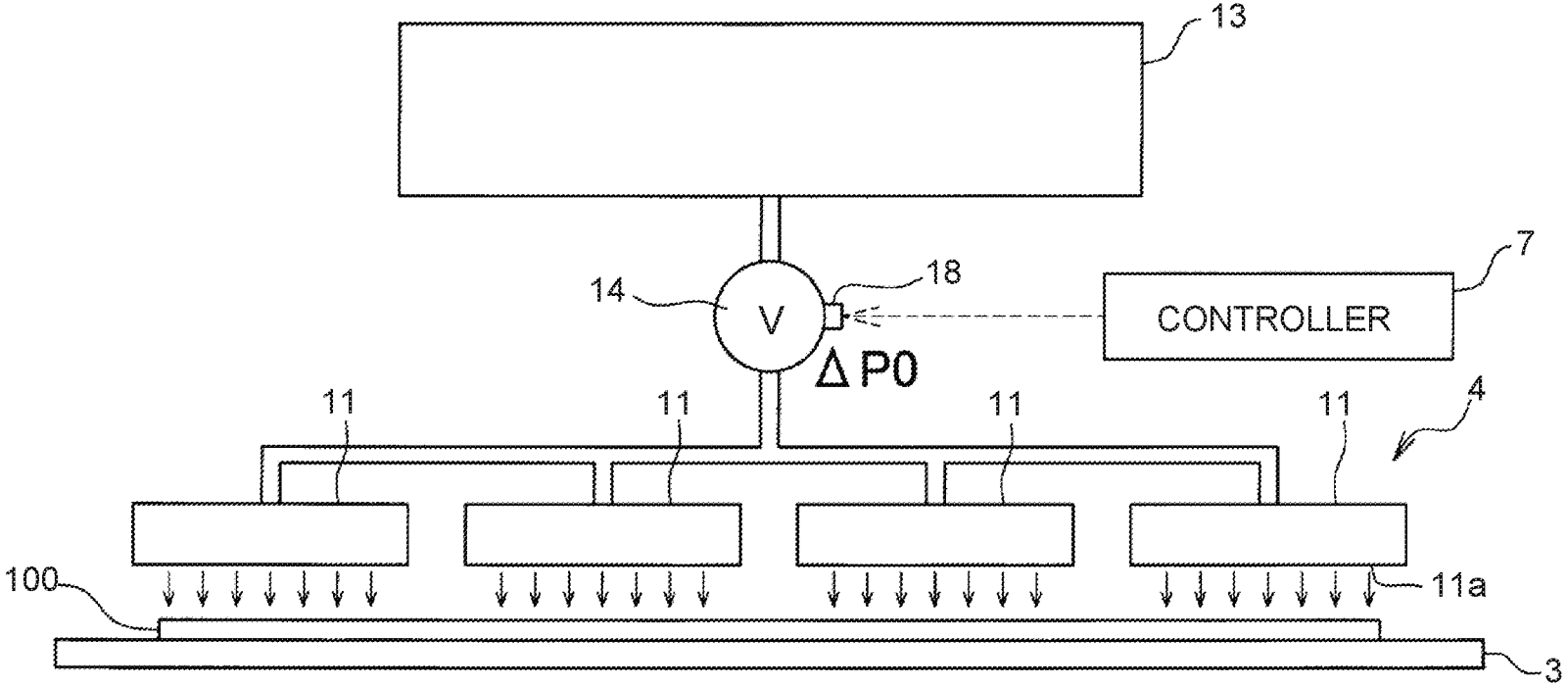
FIG. 7 is a schematic diagram of the printer during ink ejection according to one or more aspects of the disclosure.

FIG. 7 is a schematic diagram of the printer 1 during ink ejection. The controller 7 controls the pressure regulating valve 14 such that its open/close pressure differential becomes an ejection pressure differential $\Delta P0$ suitable for image formation by ink ejection from the nozzles 12 of the respective head units 11. This control may maintain a negative pressure in the respective head units 11 within a certain range with respect to the ejection pressure differential $\Delta P0$. Accordingly, ink may be supplied uniformly to respective head units 11. In addition, ink ejection from the respective nozzles 12 may stabilize.

(2) At Execution of Purging

Figure 8:
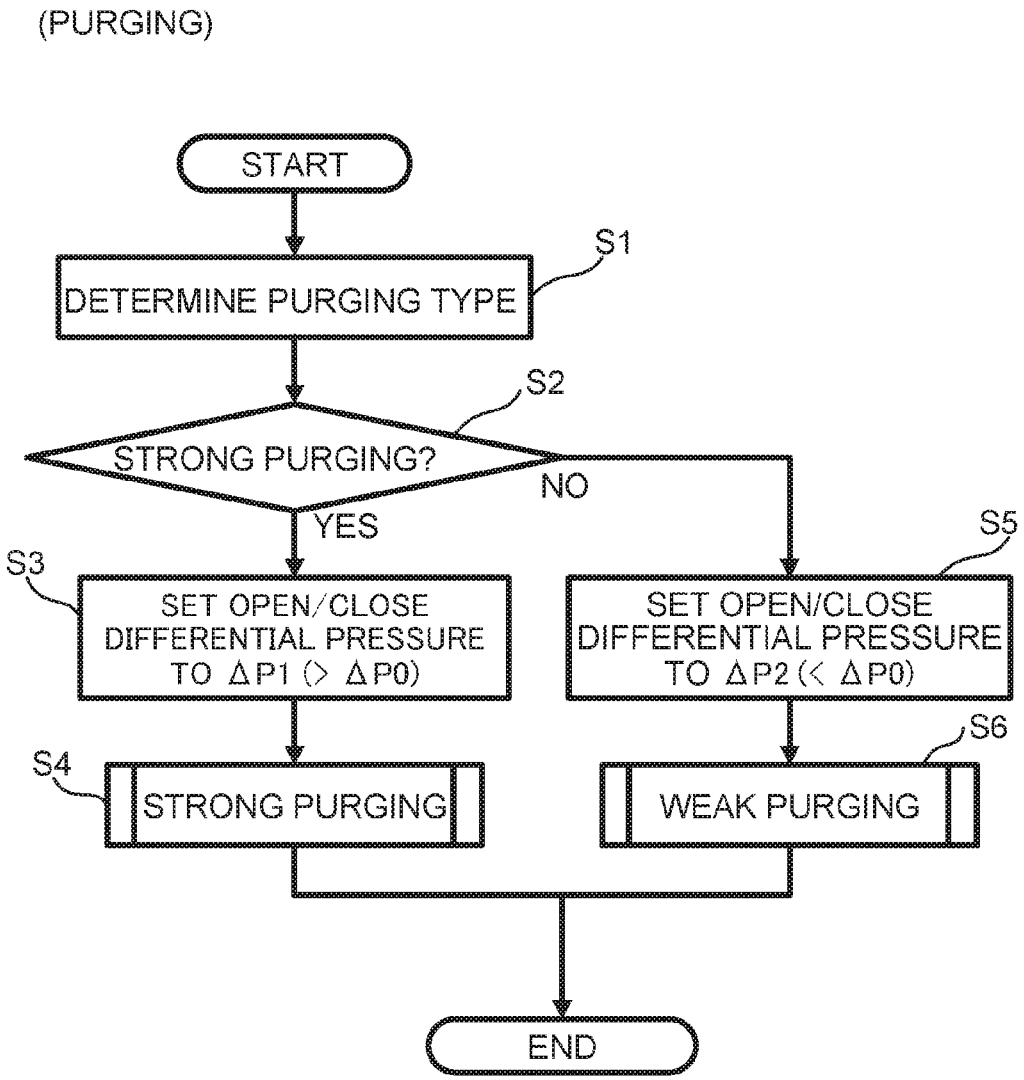
FIG. 8 is a flowchart of purging according to one or more aspects of the disclosure.

To execute purging with the purging device 15, the controller 7 changes the open/close pressure differential of the pressure regulating valve 14 from the ejection pressure differential $\Delta P0$. Purging will be described with reference to a flowchart in FIG. 8.

Purging may be performed in various situations. For example, the controller 7 of the printer 1 may perform automatic purging, as well as a manual or user-instructed purging. The automatic purging may include power-on purging that may be performed upon power-on, and a regular purging that may be regularly performed at a time when unused period of the head 4 exceeds a certain period of time. A purging instruction for the user-instructed purging may be provided via the external device 9 or a control panel of the printer 1. The printer 1 may include an ejection failure detector (not depicted) configured to detect an ejection failure of the nozzles 12. Purging, e.g., automatic purging, may be performed based on detection of an ejection failure of the nozzles 12 by the ejection failure detector.

The controller 7 determines which purging is performed, strong or weak (S1) depending on conditions at the time of executing purging. For example, at the time of the regular purging, increase in ink viscosity and inclusion of air bubbles may be usually insignificant. Thus, the weak purging may be selected for the regular purging. It may be preferable to select the strong purging, when a user provides a purging instruction or a nozzle ejection failure is detected, to recover the ejection performance of the nozzles 12. The controller 7 may not necessarily determine a purging type. For example, information on the purging type may be provided at the same time when a purging instruction is provided to the controller 7, via, for example, the external device 9.

If the strong purging is to be executed (S2: Yes), the controller 7 controls the differential pressure regulator 18 to cause the pressing member 26 to move in a direction to increase the open/close pressure differential. This may cause a change in the open/close pressure differential to a first purging pressure differential $\Delta P1$, which is greater than the ejection pressure differential $\Delta P0$ (S3). In this state, the controller 7 controls the purging device 15 to execute the strong purging (S4). An example of a first value is the first purging pressure differential ΔP1. An example of a second value is the ejection pressure differential ΔP0.

If the weak purging is to be executed (S2: No), the controller 7 controls the differential pressure regulator 18 to cause the pressing member 26 to move in a direction to reduce the open/close pressure differential. This may cause a change in the open/close pressure differential to a second purging pressure differential ΔP2, which is lower than the ejection pressure differential ΔP0 (S5). In this state, the controller 7 controls the purging device 15 to execute the weak purging (S6). An example of a third value is the second purging pressure differential ΔP2.

(Strong Purging)

Figure 9:
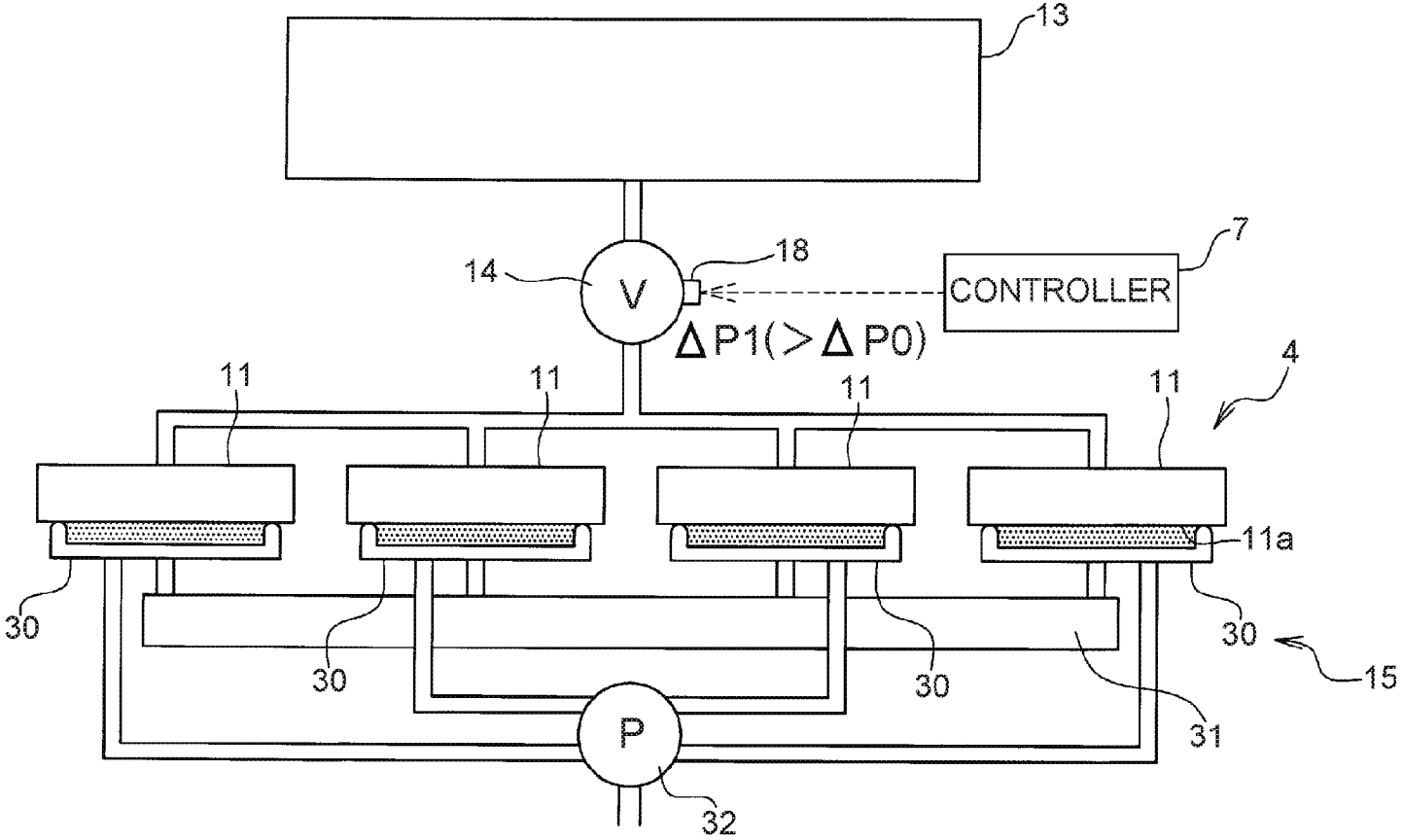
FIG. 9 is a schematic diagram of the printer during execution of strong purging.
Figure 10:
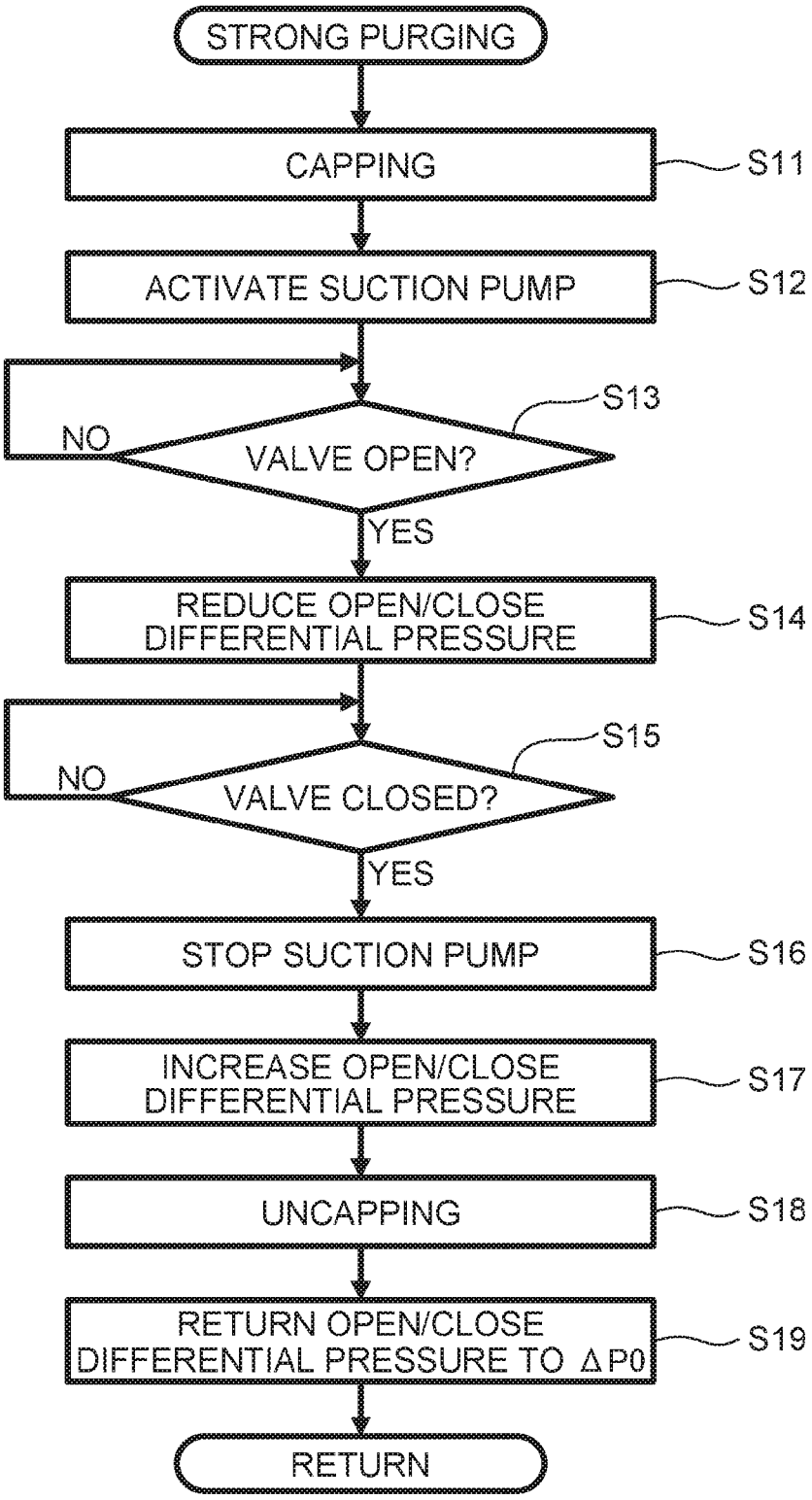
FIG. 10 is a flowchart of the strong purging according to one or more aspects of the disclosure.

The strong purging will be described in more detail below. FIG. 9 is a schematic diagram of the printer 1 during the execution of the strong purging. FIG. 10 is a flowchart of the strong purging. The controller 7 controls the platen 3 to move, thereby providing a space for the respective caps 30 at regions facing the corresponding nozzle surfaces 11*a*. Subsequently, the controller 7 controls the cap drive unit 31 to move the caps 30 to the respective contact positions, forming a sealed space therein (S11: capping). Subsequently, the controller 7 controls the suction pump 32 to start applying suction to the sealed space (S12).

Upon suctioning start, a negative pressure is created within the sealed space. Negative pressures in the head units 11 may increase accordingly. This may cause a pressure differential across the pressure regulating valve 14 (e.g., pressure differential between the fluid chambers 27 and 28) to increase. If the pressure differential exceeds the first purging pressure differential ΔP1, the pressure regulating valve 14 may open. If the open/close pressure differential of the pressure regulating valve 14 is too small for the strong purging, ink may start to be discharged from the nozzles 12 even with a slight negative pressure within the caps 30. This may result in a failure of the strong purging because a relatively large amount of ink may not flow out of the nozzles 12 swiftly.

In the illustrative embodiment, prior to the start of the strong purging, the open/close pressure differential of the pressure regulating valve 14 has been changed to the first purging pressure differential ΔP1, which is greater than the ejection pressure differential ΔP0 (S3 in FIG. 8) as described above. Immediately after the suctioning is started, a negative pressure in each head unit 11 may be small and the pressure regulating valve 14 may remain closed. As the suctioning continues, the negative pressure in the head unit 11 may increase. As the negative pressure in the head unit 11 reaches a predetermined negative pressure, the valve 14 may start to open. The open valve 14 may allow a relatively large amount of ink corresponding to the pressure differential ΔP1 to flow toward the head units 11 swiftly. In short, ink may be discharged from the respective nozzles 12 at high flow speed, leading to high purging effects.

If the open/close pressure differential (e.g., the first purging pressure differential) of the valve 14 is unchanged when the pressure regulating valve 14 is opened with increased negative pressures in the head units 11, slight reduction in the negative pressures in the head units 11 due to ink flowing may cause the valve 14 to close. This may not ensure a high ink flow speed and a desired ink amount discharge (e.g., flow rate) for the strong purging. Accordingly, when the pressure regulating valve 14 is opened (S13: Yes), the open/close pressure differential is reduced from or relative to the first purging pressure differential ΔP1 (S14) to prevent the valve 14 from being closed soon after it opens. At this time, the controller 7 controls the differential pressure regulator 18 to set the open/close pressure differential preferably to a minimum settable value, to ensure the sufficient ink amount discharge. In one example, the pressing member 26 may be placed at the lowermost position in FIGS. 5A-6, to minimize the pressing pressure against the second spring 25. This may prevent the valve 14 from be closed readily. Accordingly, ink may flow into the head units 11 with high flow rate.

A time when the pressure regulating valve 14 is opened at S13 may be determined with the following configurations. For example, a time required from the suctioning start to the valve opening may be estimated and stored in a memory. Upon reaching the estimated time, the pressure regulating valve 14 may be assumed to be open. Alternatively, a negative pressure detector (e.g., a pressure sensor) may be disposed downstream of the pressure regulating valve 14 (e.g., closer to the head unit 11). Based on the detection result of the detector, it may be determined whether the valve 14 is open. In another embodiment, a sensor configured to detect the level of the first film 22, which may be raised by the valve member 21, may be used to determine whether the valve 14 is open. Further, a switch operable in association with the vertical movement of the valve member 21 may be used to determine whether the valve 14 is open.

As the pressure regulating valve 14 opens and ink flows toward the head units 11, the negative pressures in the head units 11 may reduce gradually. When the pressure differential across the pressure regulating valve 14 (e.g., the pressure differential between the fluid chambers 27 and 28) becomes lower than the open/close pressure differential set at S14, the pressure regulating valve 14 may close (S15: Yes). At this time, the controller 7 may stop the suction pump 32, ending suctioning (S16). The suction pump 32 may not necessarily be stopped after the closing of the pressure regulating valve 14 is determined, but may be stopped upon a lapse of a predetermined time after the pressure regulating valve 14 opens.

After finishing suctioning with the suction pump 32, the controller 7 controls the cap drive unit 31 to return the caps 30 to their respective retracted positions. As the caps 30 start to move from their respective contact positions, the sealed space within each cap 30 may increase its volumetric capacity until gaps are formed between the lip portions of the respective caps 30 and the corresponding nozzle surfaces 11*a*. A negative pressure corresponding to the increased volumetric capacity may be applied to the head unit 11 side. The reduced open/close pressure differential may cause the pressure regulating valve 14 to open with this negative pressure, resulting in unwanted ink leakage.

In the illustrative embodiment, the controller 7 may not cause the caps 30 to be separated from the corresponding nozzle surfaces 11*a* immediately after the suctioning is finished. The controller 7 controls the differential pressure regulator 18 to increase the open/close pressure differential of the pressure regulating valve 14 (S17), for example, to a maximum settable value. In one example, the pressing member 26 may be placed at the uppermost position in FIGS. 5A-6, to maximize the pressing pressure against the second spring 25. Subsequently, the controller 7 controls the cap drive unit 31 to cause the caps 30 to move from their respective contact positions (S18: uncapping). Subsequent to returning of the caps 30 to their respective retracted positions, the controller 7 controls the differential pressure regulator 18 to change the open/close pressure differential of the pressure regulating valve 14 back to the ejection pressure differential ΔP0 (S19). If a change in the atmospheric pressure is caused by the caps 30 being uncapped at positions near meniscuses at the nozzles 12, ink may not leak from the nozzles 12 because the pressure regulating valve 14 remains closed.

The strong purging thus completes. After the purging, ink may often remain on the nozzle surfaces 11*a*. The remaining ink may cause, when dried, an ejection failure. Accordingly, the nozzle surfaces 11*a* may be cleaned subsequently to the purging. A wiper (not depicted) may wipe off the almost entire areas of the nozzle surfaces 11*a*. The wiping operation may clean the nozzle surfaces 11*a* and recover the state of the meniscuses at the nozzles 12. After the cleaning, the platen 3 may return to its original position (e.g., at a position facing the nozzle surfaces 11*a*) suitable for image formation, and may get ready for a new print operation.

(Weak Purging)

Figure 11:
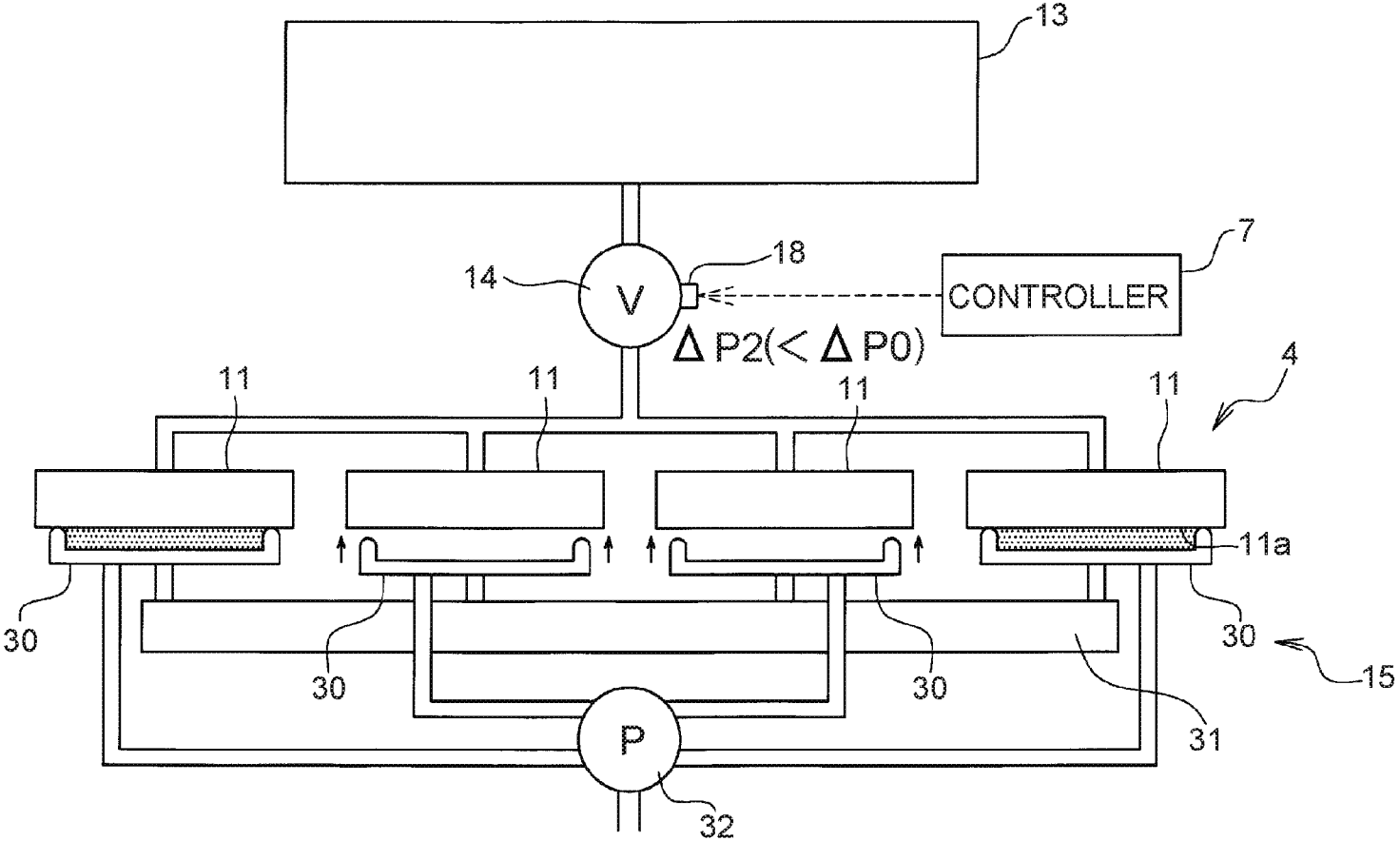
FIG. 11 is a schematic diagram of the printer during execution of weak purging according to one or more aspects of the disclosure.
Figure 12:
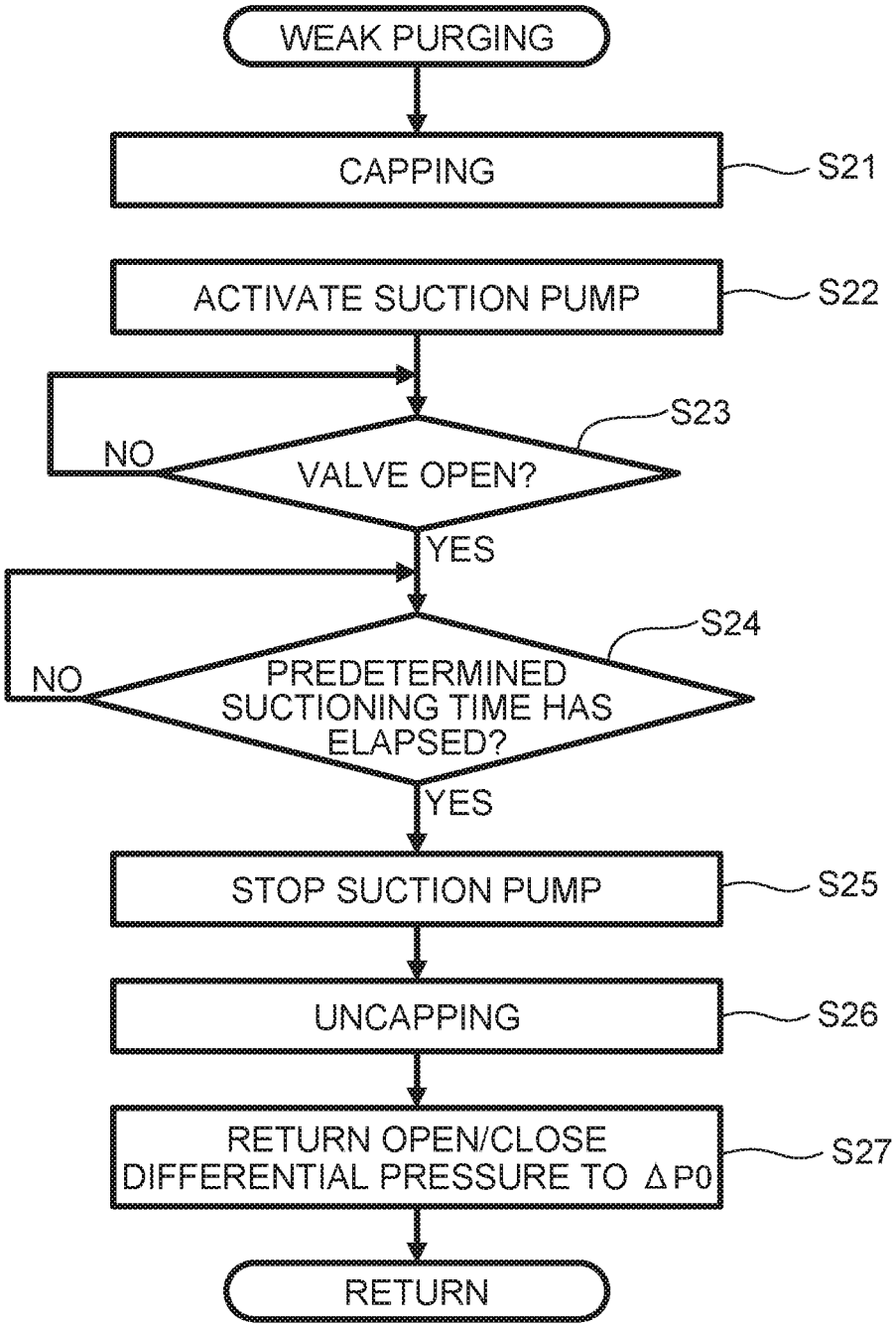
FIG. 12 is a flowchart of the weak purging according to one or more aspects of the disclosure.

Next, the weak purging will be described in more detail below. FIG. 11 is a schematic diagram of the printer 1 during the execution of the weak purging. FIG. 12 is a flowchart of the weak purging. The platen 3 may be moved for the weak purging similarly as described above in conjunction with the strong purging. Subsequently, the controller 7 controls the cap drive unit 31 to raise the respective caps 30, thereby causing the caps 30 to contact the corresponding nozzle surfaces 11*a* of the head units 11 (S21: capping). Subsequently, the controller 7 drives the suction pump 32 to start suctioning through the nozzle surfaces 11*a* (S22).

Upon starting suctioning, negative pressures may be created within the respective caps 30. Increase in the negative pressure in the corresponding head units 11 may cause a greater pressure differential across the pressure regulating valve 14. When the pressure differential exceeds the second purging pressure differential ΔP2, the pressure regulating valve 14 may open. The weak purging is intended to remove viscous ink in the nozzles 12 and minimize an ink discharge amount. It may be preferable to remove viscous ink with a relatively small amount of ink suctioning. In other words, an objective and idea of the weak purging is different from those of the strong purging in which negative pressures are accumulated in the respective head units 11 and ink is discharged from the units 11 swiftly in one go as the valve 14 opens.

In this regard, the second purging pressure differential ΔP2 is set smaller than the first purging pressure differential ΔP1, and smaller than the ejection pressure differential ΔP0, as depicted in FIG. 11. In the weak purging, slight negative pressures within the caps 30 may cause the pressure regulating valve 14 to open, which may reduce the speed of the flowing ink from the sub-tank 13 into the head units 11. In a case where the speed of the flowing ink is reduced to reduce an ink discharge amount, a suctioning time may be adjusted to discharge a desired amount of ink from the nozzles 12.

After the pressure regulating valve 14 is open (S23: Yes) and a predetermined suctioning time has elapsed (S24: Yes), the controller 7 controls the suction pump 32 to stop (S25). As described above, to reduce an ink discharge amount from the nozzles 12, the weak purging uses a reduced suctioning speed for the suction pump 32, or a shortened suctioning time at S24, as compared with the strong purging. Subsequently, uncapping is performed (S26) and the open/close pressure differential for the pressure regulating valve 14 is changed back to the ejection pressure differential ΔP0 (S27). The weak purging thus completes. Subsequent to the purging, the nozzle surfaces 11*a* may be cleaned, similar to that performed subsequent to the strong purging. Subsequent to the cleaning, the platen 3 may be returned to the original position (e.g., at a position facing the nozzle surfaces 11*a*) and may be ready for a new print operation.

During the execution of the weak purging as depicted in FIG. 12, the open/close pressure differential of the pressure regulating valve 14 may be set to the second purging pressure differential ΔP2, which is lower than the ejection pressure differential ΔP0. This setting may cause ink to leak from the nozzles 12 at the time of uncapping. To prevent or reduce the ink leakage, the open/close pressure differential may be increased prior to the uncapping, as in the strong purging (S17 in FIG. 10).

Next, modifications of the illustrative embodiment will be described. Like numerals in the drawings denote like components and the detailed description of those components described above is omitted.

1] In the illustrative embodiment, one of the strong purging and the weak purging is performed for all of the four head units 11. In another embodiment, the purge type may be selected for the respective head units 11. In one example, at one purging operation, some of the head units 11 may be subjected to the strong purging whereas the other head units 11 may be subjected to the weak purging. The strong purging and the weak purging may be simultaneously performed.

For example, if one or more of the four head units 11 have ejection failures, the head unit(s) 11 having the ejection failures may be subjected to the strong purging, while the rest of the head unit(s) 11 may be subjected to the weak purging. Tendency of ink drying may differ among the nozzles 12 of the four head units 11. For example, the head units 11 disposed at ends in the sheet width direction may be more susceptible to ink drying than the head units 11 disposed in the central portions in the sheet width direction. The head units 11 having the nozzles 12 more susceptible to ink drying may be subjected to the strong purging whereas the head units 11 having the nozzles 12 less susceptible to ink drying may be subjected to the weak purging.

Figure 13:
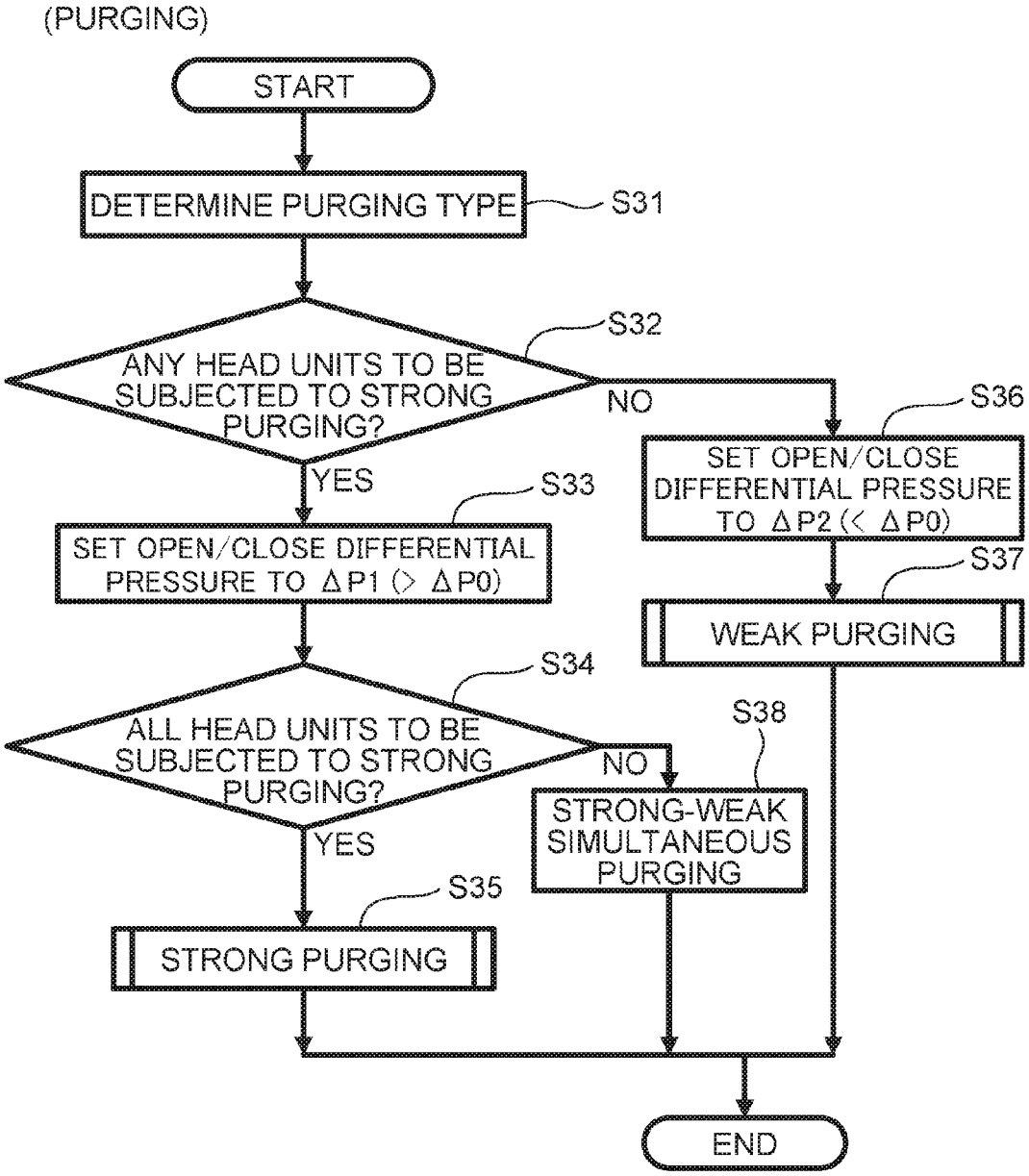
FIG. 13 is a flowchart of purging in a modification of the illustrative embodiment according to one or more aspects of the disclosure.

FIG. 13 is a flowchart of purging according to a modification of the illustrative embodiment. The controller 7 determines a purging type for each of the four head units 11 (S31).

As described above, the four head units 11 are connected to the sub-tank 13 by the respective branch passages 17 and the common passage 16. The pressure regulating valve 14 is disposed at the common passage 16 to which the four branch passages 17 join. In this configuration, if two types of purging which require different negative pressures are performed simultaneously for the four head units 11, the open/close pressure differential of the pressure regulating valve 14 may be set to the pressure differential ΔP1, which corresponds to the strong purging. The reason for that is given below.

If the open/close pressure differential of the pressure regulating valve 14 is too low, the pressure regulating valve 14 may open before a relatively greater negative pressure required for the strong purging is generated in a head unit 11 to be subjected to the strong purging. This may lead to increase in an amount of ink discharged or wasted. If at least one head unit 11 among the four units 11 is to be subjected to the strong purging, the open/close pressure differential may be set to the first purging pressure differential ΔP1 (S32: Yes).

Setting of the open/close pressure differential to the first purging pressure differential ΔP1 may cause a particular head unit 11 that requires the weak purging to discharge more ink as compared with a case in which the proper open/close pressure differential (e.g., the second purging pressure differential ΔP2) is set for the particular head unit 11. However, it may be possible to reduce an ink discharge amount in the weak purging relative to the strong purging. This may be achieved by creating a smaller negative pressure within the cap 30 for the particular head unit 11 relative to the cap 30 for another head unit 11 that requires the strong purging, which will be described in detail below.

If all of the four head units 11 are subjected to the strong purging (S34: Yes), similar to the above-described illustrative embodiment, the strong purging is performed for the four head units 11 (S35). If some head units 11 are subjected to the strong purging and the other head units 11 are subjected to the weak purging (S34: No), the strong-weak simultaneous purging (described below) may be executed (S38).

In contrast, if all of the four head units 11 are subjected to the weak purging (S32: No), the open/close pressure differential may be set to the second purging pressure differential (S36). Similar to the above-described illustrative embodiment, the weak purging may be executed for the four head units 11 (S37).

Figure 14:
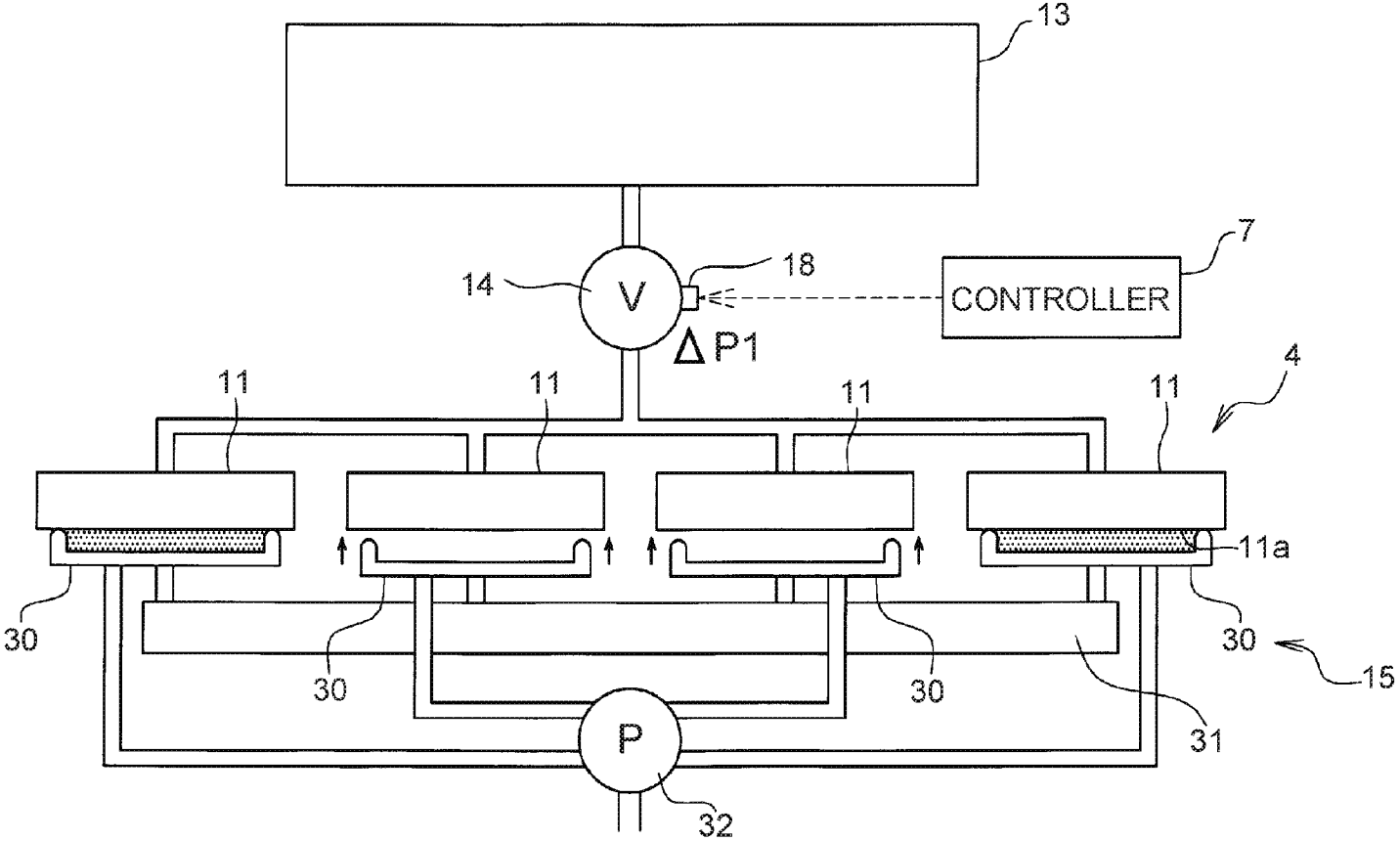
FIG. 14 is a schematic diagram of the printer performing strong-weak simultaneous purging according to one or more aspects of the disclosure.

The strong-weak simultaneous purging is now described in detail with reference to FIG. 14. FIG. 14 is a schematic diagram of the printer 1 performing the strong-weak simultaneous purging. In the configuration of FIG. 14, some particular caps 30 (e.g., the rightmost and leftmost caps 30 in FIG. 14) are brought into contact with the corresponding nozzle surfaces 11*a*, while the other caps 30 are brought closer to but not into contact with the corresponding caps 30. In this state, the suction pump 32 may be activated. This may cause the negative pressures within the particular caps 30, as well as the other caps 30. The cap drive unit 31 in FIG. 14 is configured to move four caps 30 individually in the vertical direction, as described above in conjunction with the illustrative embodiment.

In the configuration of FIG. 14, the four caps 30 may simultaneously suctioned by one suction pump 32. Some head units 11 to be subjected to the strong purging and the other head units 11 to be subjected to the weak purging may be capped at different timings to differentiate substantial suctioning times.

More specifically, prior to the suctioning operation by the suction pump 32, the controller 7 controls the cap drive unit 31 to bring one or more caps 30, which correspond to the head unit(s) 11 to be subjected to the strong purging, into contact with the corresponding nozzle surface(s) 11*a*. For example, the leftmost and rightmost head units 11 in FIG. 14 are capped completely while other head units 11 between the left and right head units 11 are not. In this state, the controller 7 may drive the suction pump 32 to start suctioning. Subsequently, the controller 7 may cause the uncapped (e.g., center-located) caps 30 to contact the corresponding nozzle surfaces 11*a* of the other head units 11. This capping may be performed during suctioning after a lapse of a predetermined time after the suctioning starts.

With this configuration, the leftmost and rightmost head units 11 in FIG. 14 that are capped prior to the suctioning start have a substantially longer suctioning time, and a relatively greater negative pressure may be created within the corresponding caps 30 accordingly. A relatively large amount of ink may be discharged at a relatively high speed from those head units 11. The other two center-located head units 11 between the leftmost and rightmost head units 11 are capped after the start of the suctioning. Those head units 11 have a substantially shorter suctioning time than the other leftmost and rightmost head units 11, and a relatively lower negative pressure may be created within the corresponding caps 30 accordingly. A relatively small amount of ink may be discharged at a relatively low speed from the center-located head units 11.

For the configuration of FIG. 14, each of the four caps 30 may be connected to a corresponding one of four suction pumps 32. In such configuration, the capping timing may not necessarily be changed between the four caps 30. The suctioning time and suctioning speed of the respective pumps 32 may be controlled for the corresponding caps 30, to vary negative pressures in the caps 30.

2] In connection with the above-described modification, purging may not necessarily be performed for all of the four head units 11 simultaneously. For example, in FIG. 14, some head units 11 having ejection failures may be capped for purging while the other head units 11 may be maintained uncapped.

3] Types of purging to be executed by the purging device 15 are not limited to two but three or more types. In such cases, the open/close pressure differential of the pressure regulating valve 14 may be set greater as a negative pressure created within the cap 30 for purging is greater.

The purging type may be one type. The open/close pressure differential for the one type of purging may be set greater than the ejection pressure differential $\Delta P0$.

4] The number of the head units 11 is not limited to four. Aspects of the disclosure may be applied to an inkjet head including only one head unit. Further, the inkjet head is not limited to a line-type head. Aspects of the disclosure may also be applied to a serial type inkjet head configured to eject ink while moving in the sheet width direction.

5] Capping and uncapping may be achieved by moving the nozzle surfaces 11*a* (e.g., the inkjet head 4) to the fixed caps 30.

6] The purging device 15 may not necessarily be disposed below the platen 3 as in the illustrative embodiment. For example, the purging device 15 may be retracted to a position away from the inkjet head 4 in the left-right direction or the front-rear direction. For purging, the purging device 15 may be moved horizontally toward a position below the nozzle surfaces 11*a*, or otherwise the inkjet head 4 may be moved toward a position above the purging device 15.

7] An actuator, such as a motor and a cylinder, may be provided for each of the caps 30 to individually move the caps 30. The cap drive unit 31 may be configured to move all of the four caps 30 simultaneously.

In the illustrative embodiment and its modifications, aspects of the disclosure is applied to an inkjet head configured to print, for example, an image, by ejecting ink on a recording sheet. Aspects of the disclosure may be applied to a liquid ejection apparatus that may have different usage than an image printing. For example, aspects of the disclosure may be applied to a liquid ejection apparatus configured to form conductive patterns on a surface of a substrate by ejecting conductive liquid on the substrate.

What is claimed is:

1. A liquid ejection apparatus, comprising:

a nozzle through which fluid is ejected or purged;

a pressure regulating valve arranged upstream of the nozzle, wherein the pressure regulating valve is configured to open in response to an open/close pressure differential of the fluid across the pressure regulating valve, and wherein the pressure regulating valve is configured to controllably regulate the open/close pressure differential; and a controller configured to:

when a suction pump is being operated to perform a first purging operation comprising creating a first negative pressure through suctioning by the suction pump to purge the fluid through the nozzle, control the pressure regulating valve to set the open/close pressure differential of the pressure regulating valve to a first value.

2. The liquid ejection apparatus according to claim 1, wherein the controller is configured to:

prior to a start of the first purging operation, control the pressure regulating valve to set the open/close pressure differential to the first value.

3. The liquid ejection apparatus according to claim 1, further comprising:

a cap; and a motor configured to move the cap between a capping position and an uncapping position, wherein when the cap is at the capping position, the cap caps the nozzle, and when the cap is at the uncapping position, the cap is positioned away from the nozzle, wherein the controller is configured to:

upon finishing the first purging operation where the suctioning by the suction pump is stopped, control the pressure regulating valve to increase the open/close pressure differential to a maximum value in a setting range of the pressure regulating valve; and subsequent to the open/close pressure differential being increased to the maximum value, control the motor to move the cap to the uncapping position.

4. The liquid ejection apparatus according to claim 1, wherein the pressure regulating valve comprises:

a valve body comprising:

a first fluid chamber in fluid communication with the nozzle; and a second fluid chamber in fluid communication with a fluid supply, the fluid supply being arranged upstream of the pressure regulating valve;

a valve member configured to move between a closed position in which a passage between the first fluid chamber and the second fluid chamber is closed, and an open position in which the passage is open;

a flexible member disposed at the first fluid chamber, the flexible member being configured to flex in accordance with reduction in the pressure in the first fluid chamber to press the valve member toward the open position;

a spring configured to bias the valve member toward the closed position;

a pressing member configured to press the spring in a direction to increase a biasing force of the spring for moving the valve member to the closed position; and a pressure differential regulator configured to be controlled by the controller to move the pressing member to alter the biasing force of the spring to set the open/close pressure differential of the pressure regulating valve.

5. The liquid ejection apparatus according to claim 1, wherein the controller configured to, when the nozzle ejects the fluid, control the pressure regulating valve to set the open/close pressure differential of the pressure regulating valve to a second value, and wherein the first value is greater than the second value.

6. The liquid ejection apparatus according to claim 5, further comprising:

a cap; and a motor configured to move the cap between a capping position and an uncapping position, wherein when the cap is at the capping position, the cap caps the nozzle, and when the cap is at the uncapping position, the cap is positioned away from the nozzle, and wherein the controller is configured to:

upon finishing the first purging operation where the suctioning by the suction pump is stopped, control the motor to move the cap to the uncapping position, and subsequent thereto, set the open/close pressure differential of the pressure regulating valve to the second value.

7. The liquid ejection apparatus according to claim 5, wherein the controller is configured to, when the suction pump is being operated to perform a second purging operation comprising creating a second negative pressure through suctioning by the suction pump to purge the fluid through the nozzle, control the pressure regulating valve to set the open/close pressure differential of the pressure regulating valve to a third value, and wherein the second negative pressure is smaller than the first negative pressure and the third value is smaller than the first value.

8. The liquid ejection apparatus according to claim 7, wherein the second value is lower than the first value and the second value is greater than the third value.

9. The liquid ejection apparatus according to claim 7, further comprising:

a first head unit including the nozzle, a second head unit including another nozzle, wherein the pressure regulating valve is in fluid communication with the first head unit and the second head unit, and wherein the controller is configured to:

when the first head unit is subjected to the first purging operation and second head unit is subjected to the second purging operation, control the pressure regulating valve to set the open/close pressure differential of the pressure regulating valve to the first value.

10. The liquid ejection apparatus according to claim 9, further comprising:

a first cap and a second cap, wherein the suction pump is in fluid communication with the first cap and the second cap; and a motor configured to:

move the first cap between a first capping position and a first uncapping position; and move the second cap between a second capping position and a second uncapping position, respectively;

wherein when the first cap is at the first capping position, the first cap caps the nozzle, and when the first cap is at the first uncapping position, the first cap is positioned away from the nozzle, and wherein when the second cap is at the second capping position, the second cap caps the another nozzle, and when the second cap is at the second uncapping position, the second cap is positioned away from the another nozzle, and wherein the controller is configured to:

prior to suctioning by the suction pump, control the motor to move the first cap to the first capping position; and after beginning the suctioning, control the motor to move the second cap to the second capping position.

11. The liquid ejection apparatus according to claim 5, wherein the controller is configured to:

when the pressure regulating valve is opened after a start of the first purging operation, control the pressure regulating valve to reduce the open/close pressure differential relative to the first value.

12. The liquid ejection apparatus according to claim 11, wherein the controller is configured to:

when the pressure regulating valve is opened after the start of the first purging operation, control the pressure regulating valve to reduce the open/close pressure differential to a minimum value in a setting range of the pressure regulating valve.

13. A liquid ejection apparatus for controlling:

a nozzle through which fluid is ejected or purged; and a pressure regulating valve arranged upstream of the nozzle, wherein the pressure regulating valve is configured to open in response to an open/close pressure differential of the fluid across the pressure regulating valve, and wherein the pressure regulating valve is configured to controllably regulate the open/close pressure differential, wherein the liquid ejection apparatus comprises:

a controller configured to:

when a suction pump is being operated to perform a first purging operation comprising creating a first negative pressure through suctioning by the suction pump to purge the fluid through the nozzle, control the pressure regulating valve to set the open/close pressure differential of the pressure regulating valve to a first value.

14. The liquid ejection apparatus according to claim 13, wherein the controller configured to, when a nozzle ejects a fluid, control the pressure regulating valve to set the open/close pressure differential of the pressure regulating valve to a second value, and wherein the first value is greater than the second value.

* * * * *